US011268753B2

(12) United States Patent
Grimaldi et al.

(10) Patent No.: US 11,268,753 B2
(45) Date of Patent: Mar. 8, 2022

(54) SPLIT REFRIGERANT COMPRESSOR FOR THE LIQUEFACTION OF NATURAL GAS

(71) Applicant: NUOVO PIGNONE TECNOLOGIE SRL, Florence (IT)

(72) Inventors: Angelo Grimaldi, Florence (IT); Antonio Pelagotti, Florence (IT)

(73) Assignee: Nuovo Pignone Technologie Srl, Florence (IT)

( * ) Notice: Subject to any disclaimer, the term of this patent is extended or adjusted under 35 U.S.C. 154(b) by 173 days.

(21) Appl. No.: 16/320,497

(22) PCT Filed: Jul. 26, 2017

(86) PCT No.: PCT/EP2017/068893
§ 371 (c)(1),
(2) Date: Jan. 25, 2019

(87) PCT Pub. No.: WO2018/024576
PCT Pub. Date: Feb. 8, 2018

(65) Prior Publication Data

US 2019/0271502 A1 Sep. 5, 2019

(30) Foreign Application Priority Data

Aug. 1, 2016 (IT) ..... 102016000080745

(51) Int. Cl.
*F25J 1/02* (2006.01)
*F25J 1/00* (2006.01)
(Continued)

(52) U.S. Cl.
CPC ..... *F25J 1/0022* (2013.01); *F04D 17/12* (2013.01); *F04D 17/122* (2013.01);
(Continued)

(58) Field of Classification Search
CPC ..... F25J 1/029; F25J 1/0295; F25J 1/0294; F25J 1/0289; F25J 1/0285; F25J 1/0022;
(Continued)

(56) References Cited

U.S. PATENT DOCUMENTS 3,527,059 A 9/1970 Rust et al.
5,791,159 A 8/1998 Aicher
(Continued)

FOREIGN PATENT DOCUMENTS

CN 101413750 B 6/2013
CN 103796747 B 8/2015
(Continued)

OTHER PUBLICATIONS

A IT Search Report and Written Opinion issued in connection with corresponding IT Application No. 102016000080745 dated May 15, 2017.

(Continued)

*Primary Examiner* — Brian M King
(74) *Attorney, Agent, or Firm* — Baker Hughes Patent Org.

(57) ABSTRACT

A compressor system is disclosed, including a first compressor unit having: at least a first gas inlet at a first gas pressure level; a second gas inlet at a second gas pressure level; and a gas discharge; a second compressor unit having: at least a third gas inlet at a third gas pressure level; a fourth gas inlet at a fourth gas pressure level; and a gas delivery. The gas discharge of the first compressor unit is fluidly coupled to one of the third gas inlet and fourth gas inlet of the second compressor unit.

14 Claims, 6 Drawing Sheets

(51) Int. Cl.
*F04D 17/12* (2006.01)
*F04D 29/58* (2006.01)

(52) U.S. Cl.
CPC ..... *F04D 29/5833* (2013.01); *F25J 1/0052* (2013.01); *F25J 1/0055* (2013.01); *F25J 1/0087* (2013.01); *F25J 1/0214* (2013.01); *F25J 1/0216* (2013.01); *F25J 1/0283* (2013.01); *F25J 1/0292* (2013.01); *F25J 1/0294* (2013.01); *F25J 1/0295* (2013.01); *F25J 2230/20* (2013.01)

(58) Field of Classification Search
CPC ..... F25J 1/0205; F25J 1/0209; F25J 1/0247; F25J 2230/22; F25J 2230/24
See application file for complete search history.

(56) References Cited

U.S. PATENT DOCUMENTS

2005/0126219 A1 6/2005 Petrowski et al.
2009/0100864 A1* 4/2009 Den Held ..... F25J 3/04018 62/643
2009/0282862 A1 11/2009 Chantant
2009/0314030 A1* 12/2009 Jager ..... F25J 1/0087 62/612
2012/0067080 A1* 3/2012 Byfield ..... F25J 1/0279 62/613
2016/0040927 A1 2/2016 Pelagotti
2016/0131422 A1* 5/2016 Kikkawa ..... F25J 1/0087 62/606
2017/0292783 A1* 10/2017 Chen ..... F25J 1/0298

FOREIGN PATENT DOCUMENTS

JP 2011506893 A 3/2011
JP 2016519277 A 6/2016
WO 0144734 A2 6/2001
WO 2009071538 A2 6/2009
WO 20110146231 A1 11/2011
WO 2013021664 A1 2/2013
WO 2014159379 A1 10/2014
WO 2015011742 A1 1/2015
WO 2016094168 A1 6/2016

OTHER PUBLICATIONS

A PCT Search Report and Written Opinion issued in connection with corresponding Application No. PCT/EP2017/068893 dated Oct. 20, 2017.

* cited by examiner

SPLIT REFRIGERANT COMPRESSOR FOR THE LIQUEFACTION OF NATURAL GAS

TECHNICAL FIELD

The present disclosure concerns systems and methods for compressing a gaseous fluid, e.g. a refrigerant in a refrigeration circuit. Embodiments disclosed herein specifically refer to systems for the production of liquefied natural gas (LNG), using one or more refrigerant circuits.

BACKGROUND OF THE INVENTION

Combustion of conventional fuels is essential in several industrial processes. Recently, in an effort to reduce the environmental impact of traditional liquid or solid fossil fuels, such as gasoline, diesel and carbon, the use of natural gas has been increased. Natural gas represents a cleaner, less polluting source of energy.

While the use of natural gas overcomes some of the disadvantages and drawbacks of conventional fossil fuels, storage and transport of natural gas poses difficulties. For transport purposes, where no gas pipelines are available, natural gas is conventionally chilled and converted into liquefied natural gas. Several thermodynamic cycles have been developed for converting natural gas in liquefied natural gas. The thermodynamic cycles usually include one or more compressors which process one or more refrigerant fluids. The refrigerant fluids undergo cyclic thermodynamic transformations to remove heat from the natural gas until this latter is finally converted in liquid phase. In some known LNG systems, pre-cooling and cooling circuits are provided, which are arranged e.g. in cascade or in other possible combinations. Different refrigerant fluids are used to chill the natural gas and/or to pre-cool another refrigerant fluid, which in turn chills the natural gas.

Several LNG systems provide for a refrigerant fluid to be compressed and expanded at several pressure levels, to exchange heat with the natural gas to be liquefied and/or with another refrigerant gas, at different pressure levels, to improve the overall efficiency of thermodynamic cycle. The compressor is in this case provided with several inlets at different pressure levels. Gas inlets at different pressure levels between the suction pressure and the delivery pressure of the refrigerant gas are also referred to as side streams.

The sequentially arranged impellers of a compressor with side streams process variable gas flow rates. Usually, one impeller is arranged at the suction side of the compressor and one additional impeller is arranged downstream of each side stream. Thus, several impellers process variable gas flow rates. The overall performance of the compressor is limited by one of the compressor phases, due to the high flow rate and low pressure ratio. Usually, in compressors having a suction side and three side streams, i.e. four compressor phases, the third phase is the most critical one. Several alternative arrangements of the side-stream compressor have been designed with an aim at solving or alleviating the above-mentioned problem. The current art arrangements, however, do not satisfactorily address this drawback and are affected by other limits and disadvantages.

FIGS. 9 to 12 illustrate propane compressor systems for LNG applications, according to the current art.

FIG. 9 illustrates a schematic embodiment of a compressor system 121 according to the current art. The compressor system 121 comprises a single compressor 141 with four gas inlets 122A-122D at decreasing pressure levels. The performances of the compressor system 121 are limited by the third compressor stage, downstream of the side stream 122B. This compressor stage, in fact, is the most critical one from the point of view of its operating point in a flow rate vs. tangential speed map.

In order to increase the performances of the compressor system 121, according to a further embodiment of the current art a parallel propane compressor arrangement as shown in FIG. 10 has been suggested. In this layout two identical compressors 141A, 141B are used and each propane flow rate at each pressure level is split into two identical sub-streams, delivered to the gas inlets 122A-122D of the two paralleled compressors 141A, 141B. This known arrangement increases the complexity of the system from a constructional point of view.

Moreover, since the flow rate of all gas inlets is reduced by 50% with respect to the total flow rate, some of the impellers operate under operating conditions which are below the optimal operating point. This factor adversely affects the overall efficiency of the compressor system 121.

A yet further arrangement of the current art is shown in FIG. 11. In this embodiment the propane compressor system 121 comprises two compressors, again labeled 141A, 141B. The first compressor 141A comprises the low pressure gas inlet 122D and the high pressure gas inlet 122B. The second compressor 141B comprises the medium pressure gas inlet 122C and the very high pressure gas inlet 122A. The delivery sides of the two compressors 141A, 141B are combined to one another and converge into the delivery 23.

A yet further layout according to the current art is shown in the schematic of FIG. 12. In this further embodiment the first compressor 141A has the low pressure gas inlet 122D and the very high gas inlet 122A. The medium pressure gas inlet 122C and the high pressure gas inlet 122B are arranged at the second compressor 141. Both embodiments of FIGS. 11 and 12 are affected by several drawbacks. Firstly, the structure of the layout is complex. Moreover, the two compressors 141A, 141B must have the same delivery pressure, while the suction pressure and side stream pressure for the two compressors are different.

The flow rate of the very high pressure gas inlet 122A is rather low, which means that the compressor including the gas inlet 122A (compressor 141B in FIG. 11, compressor 141A in FIG. 12) has a low efficiency, if the two compressors are rotated at the same speed. To increase the efficiency of the compressor system 121, two different drivers operating at different rotational speeds shall be used. Alternatively, a gearbox shall be arranged between compressor 141A and compressor 141B, if both compressors are driven by the same driver. In both cases the structure of the compressor system 121 becomes complex and prone to failure. Moreover, the gearbox inevitably causes power losses and thus an efficiency reduction.

A need therefore exists, for an improved side-stream compressor system, in particular for LNG applications.

SUMMARY

According to one aspect, a compressor system is disclosed herein, comprising a first compressor unit having: at least a first gas inlet at a first gas pressure level; a second gas inlet at a second gas pressure level; and a gas discharge. The compressor system further comprises a second compressor unit having: at least a third gas inlet at a third gas pressure level; a fourth gas inlet at a fourth gas pressure level; and a gas delivery. The gas discharge of the first compressor unit is fluidly coupled to one of said third gas inlet and fourth gas inlet of the second compressor unit. The fourth gas pressure level can be higher than the first gas pressure level and/or higher than the third gas pressure level. The second gas pressure level can be higher than the first gas pressure level and/or lower than the fourth gas pressure level.

A more efficient distribution of the side stream flow rates is thus obtained, which improves the overall performances of the compressor system with respect to the compressor systems of the prior art.

Each compressor unit can be comprised of one or more centrifugal compressors, e.g. a multi-stage centrifugal compressor.

According to a further aspect, the present disclosure concerns a refrigerant system for liquefaction of natural gas flowing in a natural gas line. The refrigerant system comprises at least a first refrigerant circuit comprised of: a compressor system as above described; a high-temperature heat exchange arrangement for discharging heat from a refrigerant fluid, delivered by the compressor system, to a heat sink; a low-temperature heat exchange arrangement, where the refrigerant fluid is in heat exchange relationship with at least one of a second refrigerant and natural gas flowing in the natural gas line, to remove heat therefrom.

According to another aspect, the subject matter disclosed herein concerns a method for compressing a gaseous fluid, comprising the following:

delivering a first plurality of gas streams at different pressure levels to a first plurality of gas inlets of a first compressor unit;

delivering a second plurality of gas streams at different pressure levels to a second plurality of gas inlets of a second compressor unit;

delivering partly compressed gas from a discharge of the first compressor unit to one of the second plurality of gas inlets of the second compressor unit;

delivering a total compressed gas flow from a gas delivery of the second compressor unit.

More specifically, disclosed herein is also a natural gas liquefaction method, comprising the following:

delivering a compressed refrigerant flow from a compressor system to a heat sink and removing heat therefrom;

dividing the refrigerant flow from the heat sink into a first plurality of partial streams and a second plurality of partial streams;

expanding each partial stream at a respective pressure level; whereby each partial stream is expanded at a pressure level different from the other partial streams;

removing heat from at least one of a second refrigerant and natural gas flowing in a natural gas line by means of the partial streams;

introducing the first plurality of partial streams in a respective plurality of first gas inlets of a first compressor unit of the compressor system; and introducing the second plurality of partial streams in a respective plurality of second gas inlets of a second compressor unit of the compressor system;

introducing refrigerant compressed by the first compressor unit into one of the plurality of second gas inlets of the second compressor unit.

Features and embodiments are disclosed here below and are further set forth in the appended claims, which form an integral part of the present description. The above brief description sets forth features of the various embodiments of the present invention in order that the detailed description that follows may be better understood and in order that the present contributions to the art may be better appreciated. There are, of course, other features of embodiments of the invention that will be described hereinafter and which will be set forth in the appended claims. In this respect, before explaining several embodiments of the invention in details, it is understood that the various embodiments of the invention are not limited in their application to the details of the construction and to the arrangements of the components set forth in the following description or illustrated in the drawings. Embodiments of the invention are capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which the disclosure is based, may readily be utilized as a basis for designing other structures, methods, and/or systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

A more complete appreciation of the disclosed embodiments of the invention and many of the attendant advantages thereof will be readily obtained as the same becomes better understood by reference to the following detailed description when considered in connection with the accompanying drawings, wherein.

DETAILED DESCRIPTION

The following detailed description of the exemplary embodiments refers to the accompanying drawings. The same reference numbers in different drawings identify the same or similar elements. Additionally, the drawings are not necessarily drawn to scale. Also, the following detailed description does not limit embodiments of the invention. Instead, the scope of embodiments of the invention is defined by the appended claims.

Reference throughout the specification to "one embodiment" or "an embodiment" or "some embodiments" means that the particular feature, structure or characteristic described in connection with an embodiment is included in at least one embodiment of the subject matter disclosed. Thus, the appearance of the phrase "in one embodiment" or "in an embodiment" or "in some embodiments" in various places throughout the specification is not necessarily referring to the same embodiment(s). Further, the particular features, structures or characteristics may be combined in any suitable manner in one or more embodiments.

In the following description reference will specifically be made to an exemplary embodiment of an LNG system, wherein a side-stream compressor system is used. More specifically, reference will be made to a so-called C3-MR liquefaction system, using a mixed refrigerant (MR) circuit and a propane (C3) circuit. The propane circuit is used as a precooling for the natural gas as well as for the mixed refrigerant. This technology is usually referred to as propane/mixed refrigerant technology. It shall however be understood that aspects of the subject matter disclosed herein can be implemented in other LNG systems using a refrigerant processed by a compressor system including side streams. For instance, embodiments disclosed herein can be used in so-called dual-mixed refrigerant circuits (DMR circuits), wherein a second mixed refrigerant is used for pre-cooling purposes, rather than propane. In other embodiments, the LNG system can use an APX process, which has substantially the same layout as a C3-MR process, with the addition of a nitrogen refrigerant subcooling cycle.

Thus, the C3-MR system described here below shall be understood as being just one example of several possible LNG systems, wherein the subject matter disclosed herein can be used.

It shall further be understood that advantages of a compressor system as disclosed herein can be usefully exploited also in other systems and methods for gas processing, whenever a compressor system with side streams is used.

Figure 1:
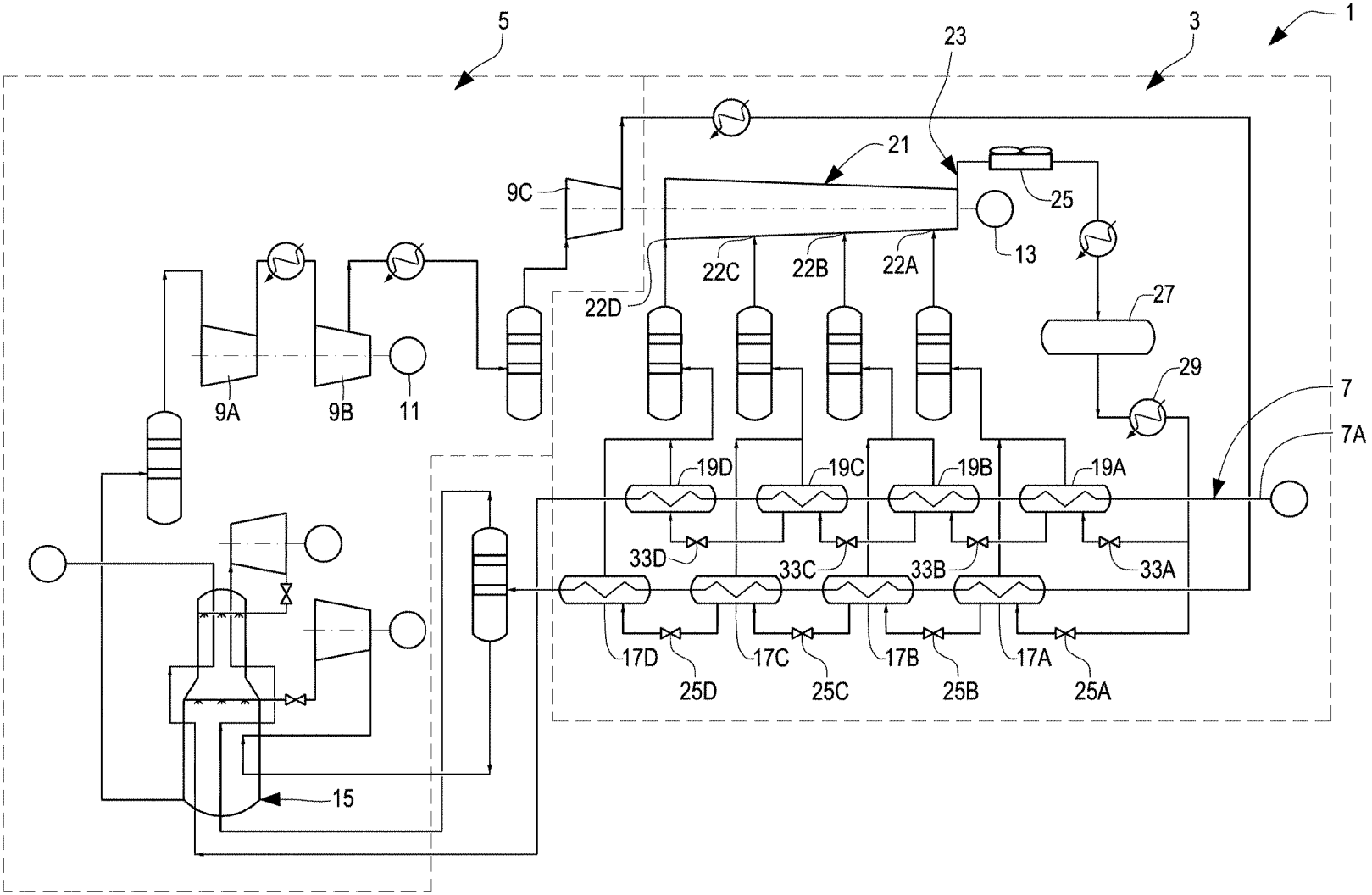
FIG. 1 illustrates a schematic of an exemplary embodiment of an LNG system using a refrigerant compressor with side streams.

A schematic of the exemplary LNG system according to the C3-MR technology is shown in FIG. 1. The LNG system, globally labeled 1, is known to those skilled in the art and herein only a general description of the system will be given, for a better understanding of the novel embodiments disclosed herein.

The system 1 includes a propane pre-cooling section 3 and a mixed refrigerant section 5.

Both sections 3 and 5 comprise a refrigerant circuit including a compressor system, a high-temperature heat exchanger arrangement for discharging heat from the refrigerant fluid circulating in the refrigerant circuit, a low temperature heat exchange arrangement, where the refrigerant fluid is in heat exchange relationship with another refrigerant and/or with the natural gas to be liquefied.

The natural gas flows in a main line 7 from a natural gas inlet 7A to a liquefied natural gas outlet 7B. The main line 7 extends through the propane pre-cooling section 3 and through the mixed refrigerant section 5.

In the exemplary layout of FIG. 1, the mixed-refrigerant section 5 comprises mixed refrigerant compressors 9A, 9B, 9C, which can be driven by one or more drivers. In some embodiments the mixed refrigerant compressors 9A, 9B are driven by a first driver 11, e.g. a gas turbine engine. The third, high-pressure mixed refrigerant compressor 9C can be driven into rotation by a second driver 13, e.g. a further gas turbine engine. The second driver 13 can be used also to drive a propane compressor system or part thereof, as will be described later on and as schematically shown in FIG. 1.

Reference number 15 indicates a main cryogenic heat exchanger (MCHE), wherein the chilled mixed refrigerant exchanges heat against the natural gas.

The compressed mixed refrigerant delivered by compressor 9C is precooled in a first set of precooling heat exchangers 17A-17D, by exchanging heat against chilled propane at a plurality of different pressure levels. In the exemplary embodiment of FIG. 1 four pressure levels are used. A second set of precooling heat exchangers 19A-19D is further provided, wherein the chilled propane at the same four pressure levels exchanges heat against the natural gas flowing in line 7, to precool the natural gas prior to entering the MCHE 15.

The compressed propane is provided by a propane compressor system 21. A delivery 23 of the propane compressor system 21 is fluidly coupled with heat exchangers and condensers 25, 27, 29, wherefrom compressed and condensed propane is delivered at the first set of precooling heat exchangers 17A-17D. The heat exchangers and condensers 25, 27, 29 form a high-temperature heat exchange arrangement, where heat is removed from the compressed propane by heat exchange against air, water or another cooling medium, defining a heat sink.

Expansion valves 31A-31D and 33A-33D are provided, for sequentially expanding the propane at the four pressure levels. References 22A-22D designate four gas inlets of the propane compressor system 21, which are fluidly coupled to the precooling, heat exchangers 17A-17D and 19A-19D of the first set and second set, respectively. The first inlet 22D at the lowest pressure level is usually referred to as suction side of the compressor system 21, while the other gas inlets 22C, 22B, 22A are usually referred to as side-streams. In the context of the present disclosure, the suction side and the side streams are globally referred to as gas inlets.

The precooling heat exchangers 17A-17D, 19A-19D form a low temperature heat exchange arrangement, where propane is in heat exchange relationship with both the mixed refrigerant and the natural gas for pre-cooling purposes.

The precooling heat exchangers 17D, 19D at the lowest pressure are fluidly coupled to the suction side, i.e. to the lowest pressure inlet 22D of the propane compressor system 21. The precooling heat exchangers 17C, 19C, 17B, 19B and 17A, 19A at gradually increasing pressure levels are fluidly coupled to the propane compressor system 21 through the side stream inlets 22C, 22B and 22A, respectively. Here below, the pressure levels at the inlets 22D, 22C, 22B and 22A will be also referred to as: low pressure (LP), medium pressure (MP), high pressure (HP) and very high pressure (HHP) respectively.

The compressor system 21 usually comprises four compression stages and four or more impellers, i.e. at least one impeller for each gas inlet 22D-22A. In some embodiments, the compressor system 21 comprises five impellers. The possibility of having more than five impellers is not excluded.

Figure 2:
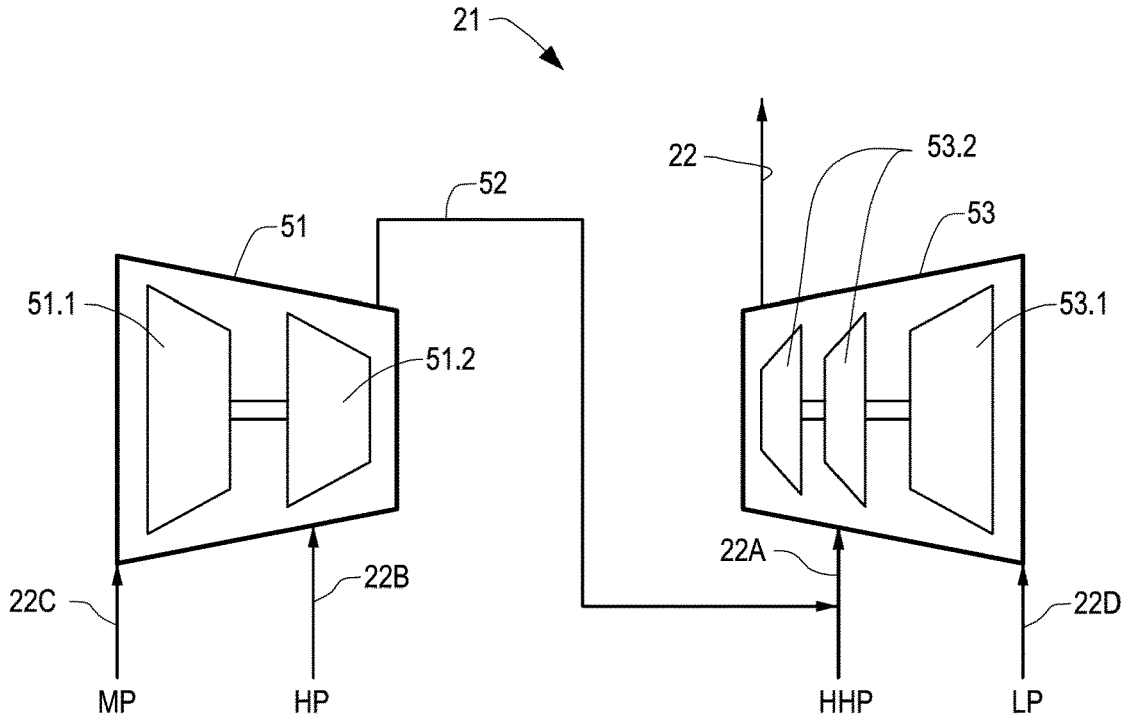
FIGS. 2, 3 and 4 illustrate embodiments of a refrigerant compressor system according to the present disclosure.

An embodiment according to the present disclosure, aimed at solving or alleviating at least one of the above discussed drawbacks of the current art is shown in FIG. 2. The compressor system is again labeled 21 as a whole. In the embodiment of FIG. 2, the compressor system 21 comprises a first compressor unit 51 and a second compressor unit 53.

In general, each compressor unit 51, 53 comprises at least two gas inlets. Since in the presently described embodiments the precooling circuit comprises four propane pressure levels, the first compressor unit 51 comprises a first gas inlet and a second gas inlet; the second compressor unit 53 comprises a third gas inlet and a fourth gas inlet.

It shall be understood that utilizing more than four propane pressure levels is not excluded, in which case at least one of the compressor units 51, 53 may include more than two gas inlets.

In FIG. 2 the first compressor unit 51 comprises two compressor stages 51.1 and 51.2. By way of example, each compressor stage 51.1 and 51.2 comprises one impeller. The use of more than one impeller for one or both stages 51.1 and 51.2 is not excluded, however.

The first compressor stage 51.1 has a first gas inlet 22C receiving propane at the medium propane pressure MP. The second compressor stage 51.2 receives partly compressed propane from the first compressor stage 51.1 and propane from the side stream or second gas inlet 22B at the high propane pressure HP.

As shown in FIG. 2, the first compressor unit 51 is a straight through compressor unit, wherein a single gas flow for each pressure level is provided. I.e. the first gas inlet 22C receives the full gas flow at a first pressure, and the second gas inlet 22B receives the full gas flow at the second pressure. The compressor unit discharge 52 receives a gas flow consisting of the gas flow entering the first gas inlet 22C and the second gas inlet 22B. The same straight through layout is provided in further embodiments disclosed here below, wherein a single gas flow, i.e. a single gas inlet is provided for each pressure level.

The second compressor unit 53 comprises a third compressor stage 53.1 and a fourth compressor stage 53.2. The third compressor stage 53.1 can comprise a single impeller, while in this exemplary embodiment the fourth compressor stage 53.2 comprises two impellers. Any different number of impellers for each compressor stage can be envisaged, however.

The third compressor stage 53.1 receives a propane side stream at the third gas inlet 22D at the low propane pressure LP. The fourth compressor stage 53.2 receives a propane side stream at the fourth gas inlet 22A at the very high propane pressure HHP. The fourth compressor stage 53.2 further receives the total flow rate delivered by the discharge 52 of the first compressor unit 51, consisting of the gas flows from the first gas inlet 22C and the second gas inlet 22B.

Thus, in the first compressor stage 51.1 the gas is compressed from medium pressure MP to high pressure HP, while in the second compressor stage 51.2 the gas is compressed from high pressure HP to very high pressure MP. The third compressor stage 53.1 compresses the gas from low pressure LP to very high pressure HHP, while the fourth compressor stage 53.2 compresses the gas from the very high pressure HHP to the upper propane pressure in the propane cycle.

As shown in FIG. 2, also the second compressor unit 53 is a straight through compressor unit, wherein a single gas flow for each pressure level is provided. I.e. the third gas inlet 22D receives the full gas flow at a third pressure, and the fourth gas inlet 22A receives the full gas flow at the fourth pressure.

Figure 10:
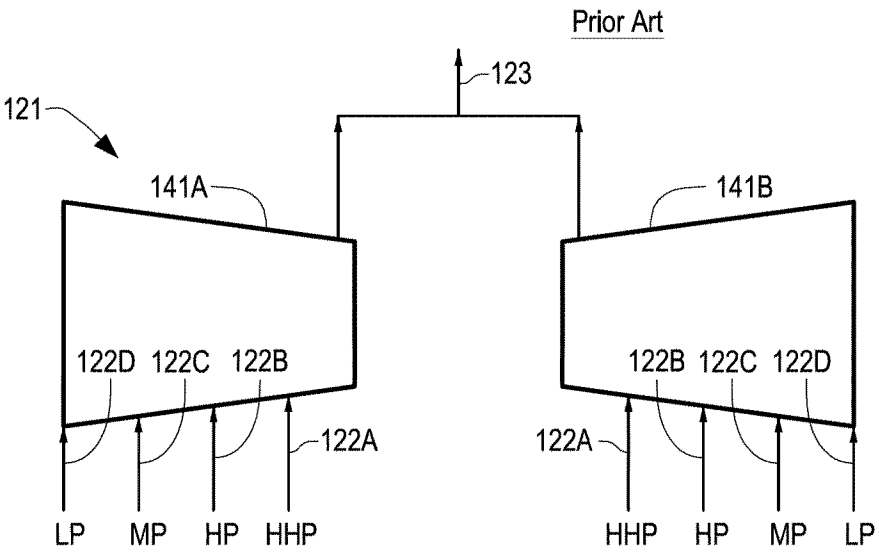
Figure 11:
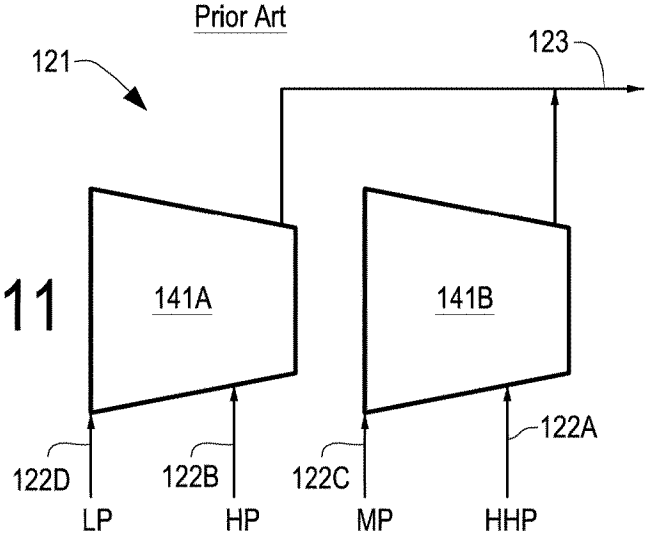
Figure 12:
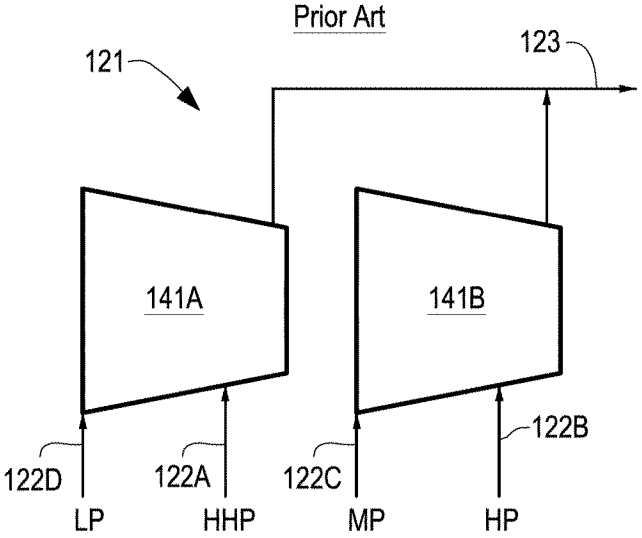

The overall structure of the compressor system 21 is simpler than in the arrangements of the current art (FIG. 10). Also the control of the compressor system 21 is simpler than in the prior art (FIGS. 11, 12). In particular, with respect to the arrangement of FIGS. 11 and 12, in the arrangement of FIG. 2 the compressor units 51 and 53 have a single delivery side 23 in direct fluid communication with the high-temperature heat exchanger, such that control of the compressor system 21 is made simpler.

With respect to FIG. 10, the compressor system of the present disclosure avoids the use of a dual-flow compressor arrangement, where gas side streams at the same pressure are split among two separate gas inlets. A structure is thus obtained, which is simpler than that of the current art systems using a dual flow or parallel flow arrangements.

Figure 3:
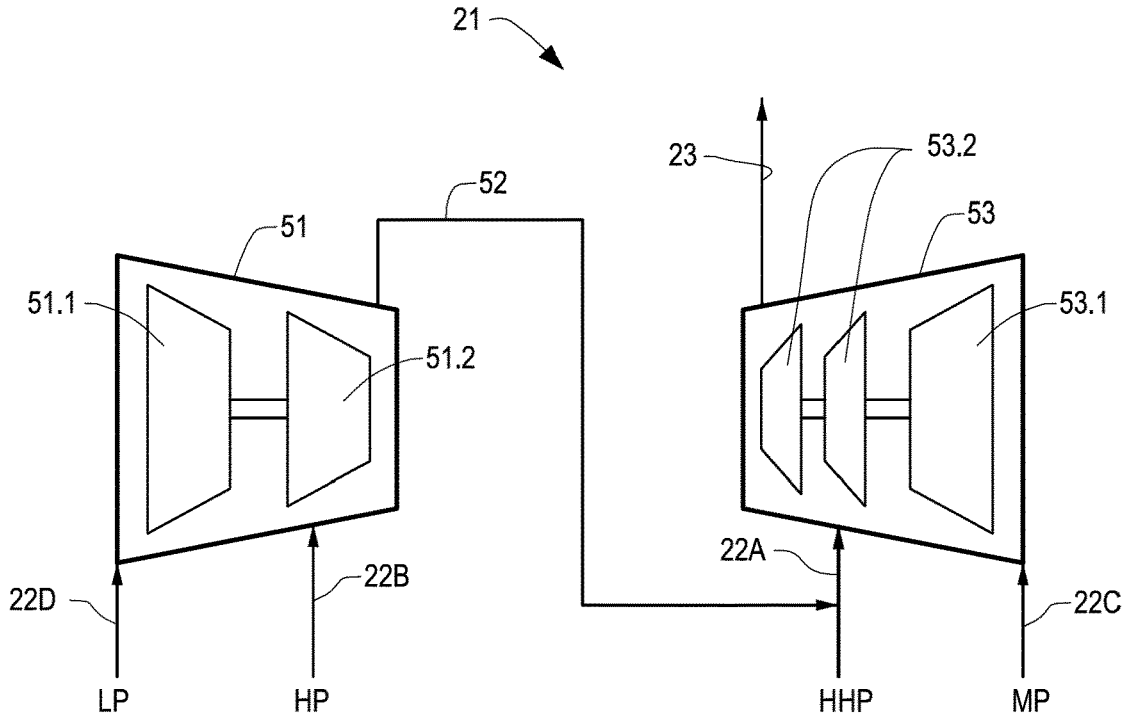

FIG. 3 illustrates a further embodiment of a compressor system according to the present disclosure. The same references as in FIG. 2 designate the same or equivalent parts, components or elements of the compressor system 21. The difference between FIGS. 2 and 3 concerns the arrangement of the low pressure gas inlet 22D and medium pressure gas inlet 22C, the positions whereof are reversed with respect to the arrangement of FIG. 2. In FIG. 3 the first compressor unit 51 receives low pressure (LP) propane at the gas inlet 22D and high pressure (HP) propane at the gas inlet 22B. The second compressor unit 53 receives medium pressure (MP) propane at the gas inlet 22C and very high pressure (HHP) propane at the gas inlet 22A.

The discharge 52 of the first compressor unit 51 is fluidly coupled to the gas inlet arranged between the third compressor stage 53.1 and the fourth compressor stage 53.2. The compressed propane stream from the first compressor unit 51 is mixed with the very high propane pressure stream at gas inlet 22A and delivered through the last compressor stage 53.2.

Thus, in the first compressor stage 51.1 the gas is compressed from pressure LP to pressure HP, while in the second compressor stage 51.2 the gas is compressed from pressure HP to pressure HHP. The third compressor stage 53.1 compresses the gas from pressure MP to pressure HHP, while the fourth compressor stage 53.2 compresses the gas from pressure HHP to the upper propane pressure in the propane cycle.

Figure 4:
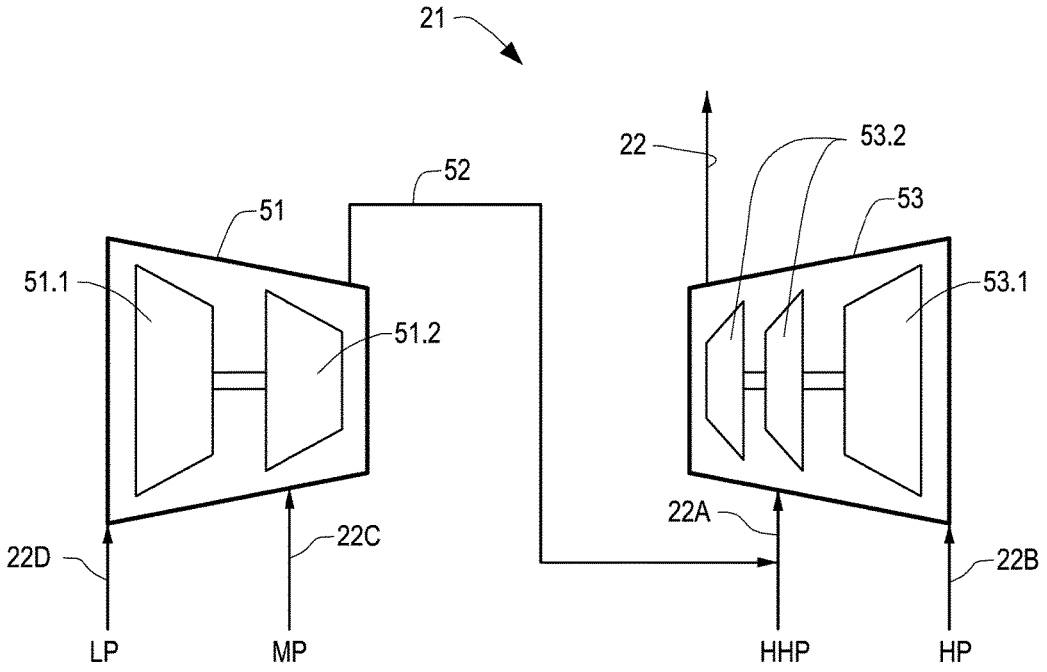

A further embodiment of the compressor system 21 according to the present disclosure is shown in FIG. 4. The same references are used as in FIGS. 2 and 3 to designate the same or equivalent parts, components or elements. The arrangement of FIG. 4 differs from the arrangement of FIG. 3 mainly because the arrangement of the gas inlets 22C and 22B is reversed.

In FIG. 4 the first compressor unit 51 receives low pressure (LP) propane at gas inlet 22D and medium pressure (MP) propane at gas inlet 22C, while the second compressor unit 53 receives high pressure (HP) propane at gas inlet 22B and very high pressure (HHP) propane at gas inlet 22A.

The discharge 52 of the first compressor unit 51 is fluidly coupled to the gas inlet arranged between the third compressor stage 53.1 and the fourth compressor stage 53.2. The compressed propane flow from the first compressor unit 51 is mixed with the propane at very high pressure at the gas inlet 22A and delivered through the last compressor stage 53.2.

Thus, in the first compressor stage 51.1 the gas is compressed from pressure LP to pressure MP, while in the second compressor stage 51.2 the gas is compressed from pressure MP to pressure HHP. The third compressor stage 53.1 compresses the gas from pressure HP to pressure HHP, while the fourth compressor stage 53.2 compresses the gas from HHP to the upper propane pressure in the propane cycle.

Figure 9:
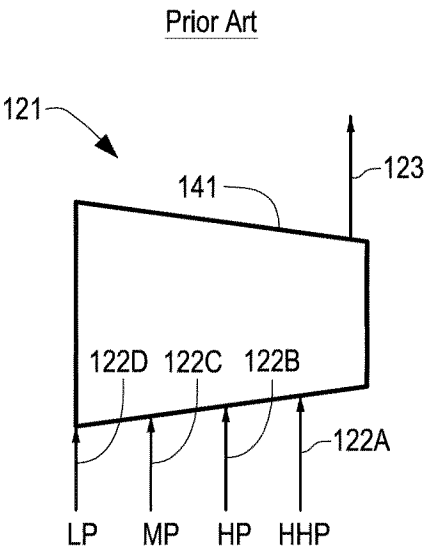
FIGS. 9, 10, 11 and 12 illustrate current art arrangements of side stream compressors for LNG applications, described above.

As can be appreciated from FIGS. 2 to 4, in all embodiments the flow rate through the most critical compression stage from the HP to HHP is reduced. In fact, while in the basic current art embodiment of FIG. 9 the compressor stage which compresses the gas from HP to HHP processes the total flow rate given by the sum of the flow rates through gas inlets 122D, 122C, 122B, in the embodiment of FIG. 2, for instance, the compressor stage 51.2 only processes the flow rate of gas inlets 22C and 22B. In the embodiment of FIG. 3, the critical compressor stage 51.2 only processes the flow rate of gas inlets 22D and 22B. Finally, in the embodiment of FIG. 4 the critical compressor stage 53.1 only processes the flow rate of gas inlet 22B.

With respect to the current art arrangements of FIGS. 11 and 12, the embodiments disclosed herein provide for a single outlet or delivery side 23 of the compressor system 21, such that control of the operation of the compressor units 51 and 53 is made simpler and more reliable.

FIGS. 2 to 4 illustrate possible examples of compressor stage arrangements and relevant fluid couplings therebetween. The various arrangements can be embodied in different configurations as far as the number of compressor casings, driving shafts, drivers and connecting ducts are concerned. Possible configurations are shown in FIGS. 5 to 8.

Figure 5:
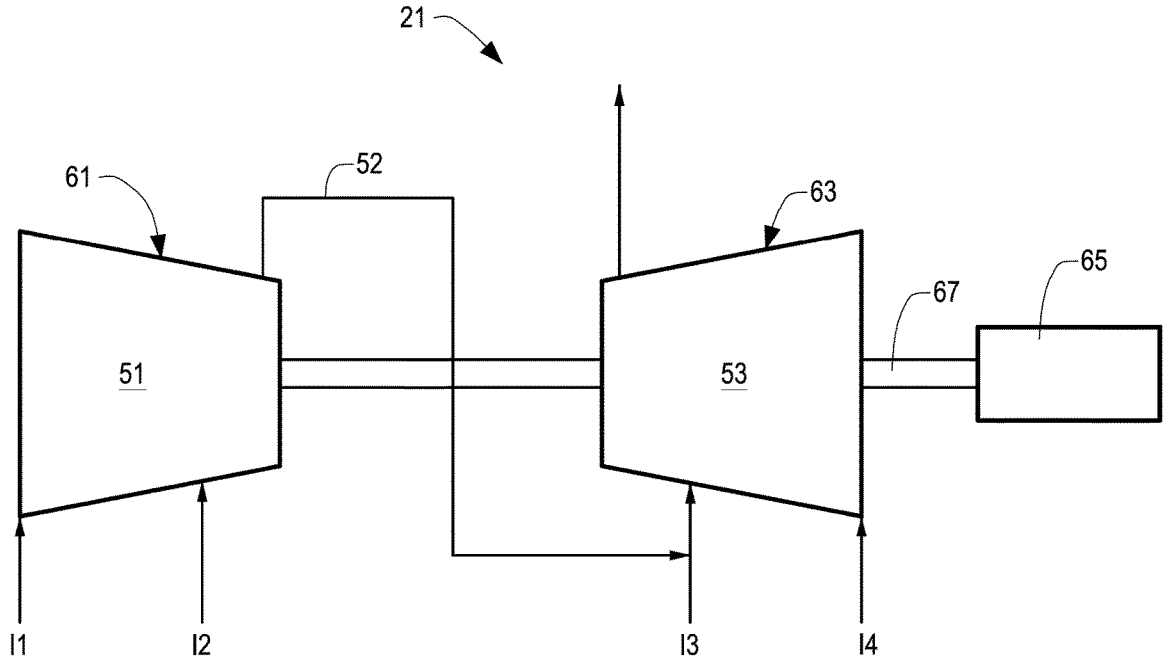
FIGS. 5 to 8 illustrate embodiments of the casing and driver arrangement for a compressor system according to the present disclosure.

FIG. 5 illustrates a compressor system 21 comprising two separate compressor casings 61, 63. The compressor casing 61 can contain the compressor unit 51 of any one of FIGS. 2, 3 and 4. The compressor casing 63 can contain the compressor unit 53 of any one of FIGS. 2, 3 and 4. Since the arrangement of FIG. 5 can refer to any one of the configurations of FIGS. 2, 3 and 4, the gas inlets of the two compressor casings 61 and 63 are generically indicated as I1, I2, I3, I4, respectively the first, second, third and fourth gas inlets. The discharge 52 of compressor unit 51 is fluidly coupled to the gas inlet I3 of compressor unit 53. Reference number 67 designates a driver which rotates the two compressor units 51, 53 through shaft 65.

Figure 6:
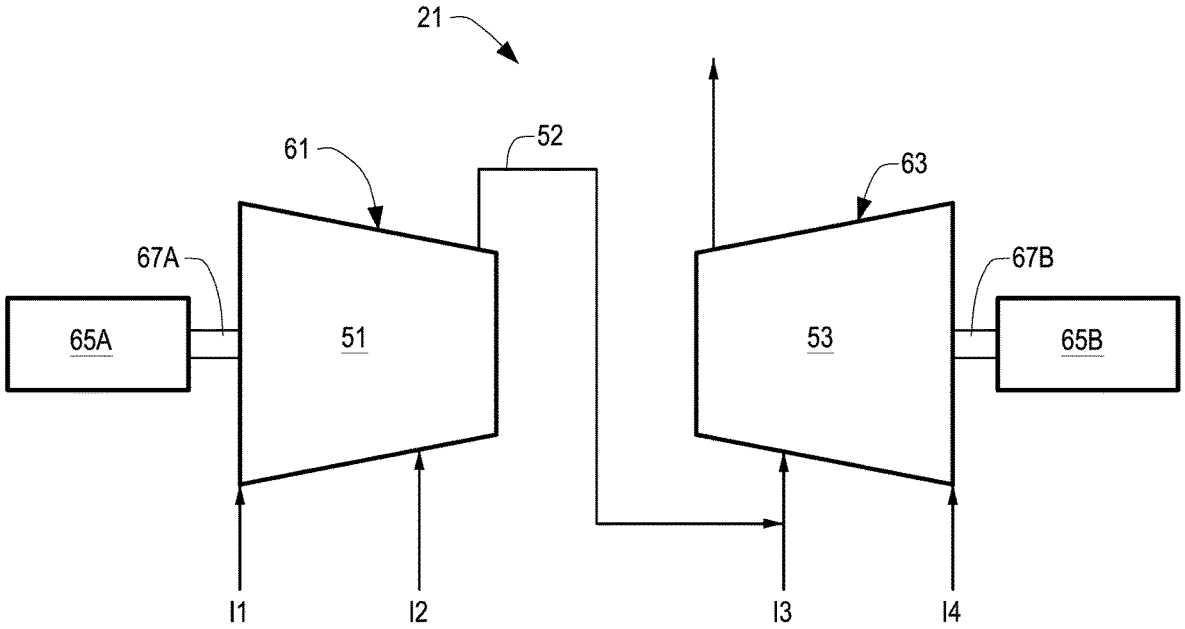

FIG. 6 illustrates a compressor system 21 comprising two compressor units 51, 53, which are driven into rotation by separate drivers 65A, 65B through shafts 67A, 67B and can thus operate at different rotational speeds. Gas inlets are shown at I1, I2, I3, I4. The outlet of compressor unit 51 is fluidly coupled to the gas inlet I3 of compressor unit 53.

Figure 7:
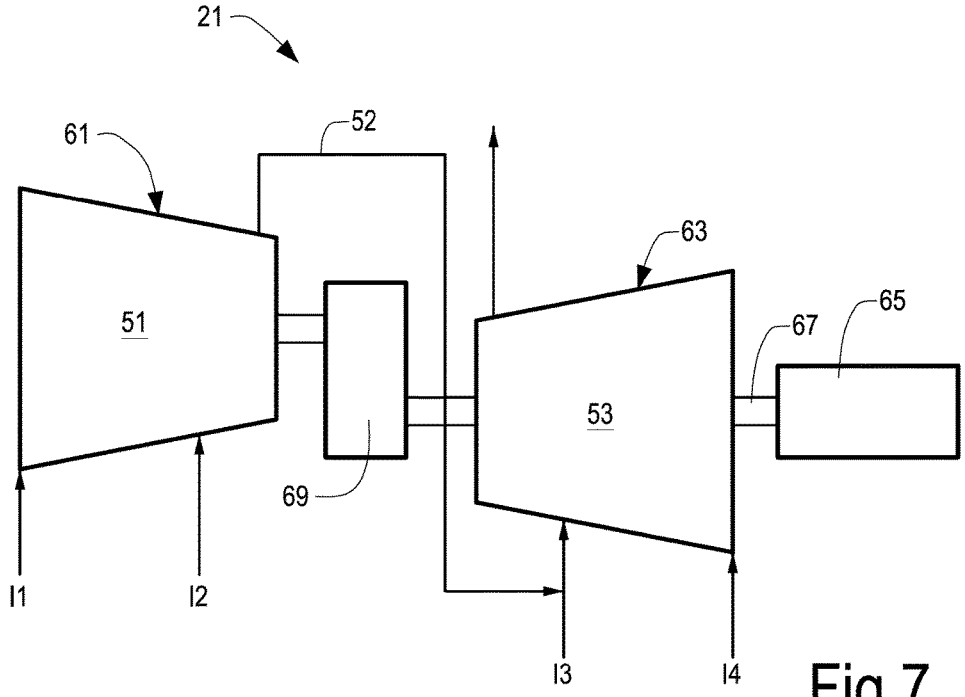

FIG. 7 illustrates an arrangement similar to FIG. 5, wherein a gear box 69 is arranged between compressor unit 51 and compressor unit 53 such that the two compressor units can rotate at different rotation speeds. The remaining reference numbers designate the same parts, elements or components as in FIG. 5.

Figure 8:
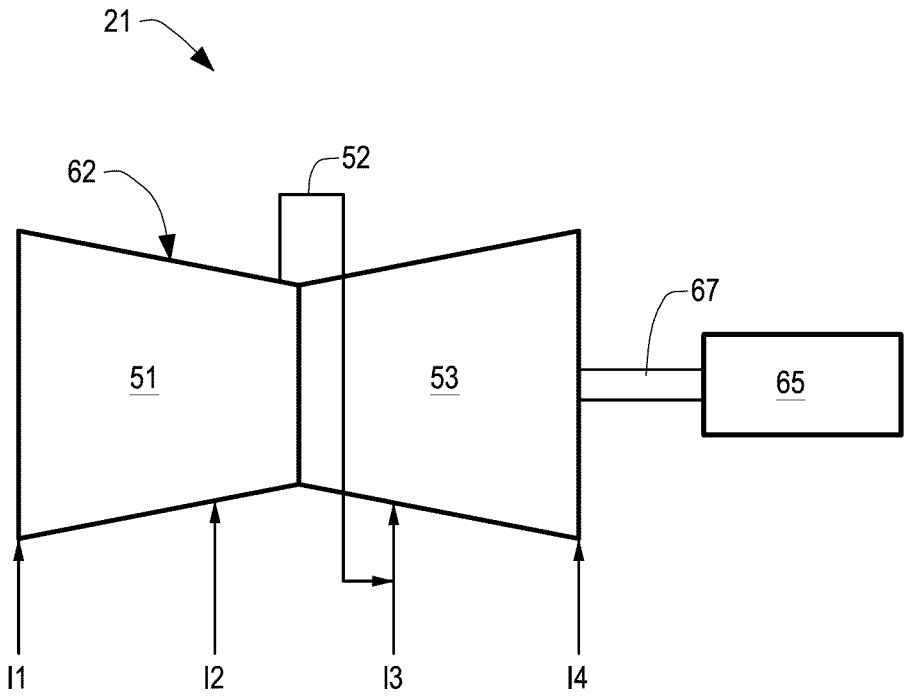

A yet further embodiment of the compressor system 21 is shown in FIG. 8. The two compressor units 51, 53 are arranged in a single casing 62 in a back-to-back configuration. The fluid connection between the outlet of compressor unit 51 and the gas inlet I3 of compressor unit 51 can be located inside or outside the casing 62.

While the disclosed embodiments of the subject matter described herein have been shown in the drawings and fully described above with particularity and detail in connection with several exemplary embodiments, it will be apparent to those of ordinary skill in the art that many modifications, changes, and omissions are possible without materially departing from the novel teachings, the principles and concepts set forth herein, and advantages of the subject matter recited in the appended claims. Hence, the proper scope of the disclosed innovations should be determined only by the broadest interpretation of the appended claims so as to encompass all such modifications, changes, and omissions. In addition, the order or sequence of any process or method steps may be varied or re-sequenced according to alternative embodiments.

This written description uses examples to disclose the invention, including the preferred embodiments, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A compressor system for compressing a first refrigerant comprising:

a first compressor unit comprising: a first gas inlet that is configured to receive the first refrigerant at a first gas pressure level; a second gas inlet that is configured to receive the first refrigerant at a second gas pressure level and is located downstream of the first gas inlet; and a gas discharge located downstream of the second gas inlet; and a second compressor unit comprising: a third gas inlet that is configured to receive the first refrigerant at a third gas pressure level; a fourth gas inlet that is configured to receive the first refrigerant at a fourth gas pressure level and is located downstream of the third gas inlet;

wherein the gas discharge of the first compressor unit is fluidly coupled to the fourth gas inlet of the second compressor unit;

wherein the fourth gas pressure level is higher than the first gas pressure level and higher than the second gas pressure level, and the second gas pressure level is higher than the first gas pressure level; and wherein (i) if the second gas pressure level is lower than the third pressure level, then the flow rate through a compression stage from the third gas inlet to fourth gas inlet is reduced, and (ii) if the second gas pressure level is higher than the third pressure level, then the flow rate through a compression stage from the second gas inlet to fourth gas inlet is reduced.

2. The compressor system of claim 1, wherein the second compressor unit has only the third gas inlet and the fourth gas inlet as gas inlets.

3. The compressor system of claim 1, wherein the first compressor unit has a first compressor stage with a single impeller and a second compressor stage with a single impeller, and wherein the second compressor unit has a third compressor stage with a single impeller and a fourth compressor stage with two impellers.

4. The compressor system of claim 1, wherein the first compressor unit is housed in a first casing, and the second compressor unit is housed in a second casing.

5. The compressor system of claim 1, wherein the first straight compressor unit and the second compressor unit are housed in a common casing.

6. The compressor system of claim 5, wherein a first impeller group consisting of impellers included in the first compressor unit and a second impeller group consisting of impellers included in the second compressor unit are positioned in line and in a back-to-back arrangement.

7. The compressor system of claim 1, wherein the first compressor unit and the second compressor unit are arranged and control led to rotate at substantially the same rotational speed.

8. The compressor system of claim 1, wherein the first compressor unit and the second compressor unit are arranged and controlled to rotate at different rotational speeds.

9. The compressor system of claim 8, further comprising a gearbox arranged between the first compressor unit and the second compressor unit.

10. The compressor system of claim 8, wherein the first compressor unit is driven by a first driver and the second compressor unit is driven by a second driver.

11. A refrigerant system for liquefaction of natural gas, comprising:

a natural gas line; and at least a first refrigerant circuit comprising the compressor system of claim 1;

a high-temperature heat exchange arrangement for discharging heat from a first refrigerant delivered by the compressor system; and a low-temperature heat exchange arrangement, wherein the first refrigerant is in heat exchange relationship with at least one of a second refrigerant and natural gas flowing in the natural gas line to remove heat therefrom, wherein the low-temperature temperature heat exchange arrangement comprises heat exchangers, each heat exchanger fluidly coupled with each gas inlet in the compressor system.

12. A method for compressing a first refrigerant by using a first compressor unit comprising: a first gas inlet; a second gas inlet located downstream of the first gas inlet; and a gas discharge located downstream of the second gas inlet and a second compressor unit comprising: a third gas inlet; a fourth gas inlet located downstream of the third gas inlet, the method comprising:

introducing a single gas flow of the first refrigerant at a first gas pressure level into the first gas inlet;

introducing a single gas flow of the first refrigerant at a second gas pressure level into the second gas inlet;

introducing a gas flow of the first refrigerant at a third gas pressure level into the third gas inlet;

introducing a gas flow of the first refrigerant at a fourth gas pressure level into the fourth gas inlet; and introducing a gas flow of the first refrigerant from the first compressor unit into the fourth gas inlet of the second compressor unit, wherein the fourth gas pressure level is higher than the first gas pressure level and higher than the second gas pressure level, and the second gas pressure level is higher than the first gas pressure; and wherein (i) if the second gas pressure level is lower than the third pressure level, then the flow rate through a compression stage from the third gas inlet to fourth gas inlet is reduced, and (ii) if the second gas pressure level is higher than the third pressure level, then the flow rate through a compression stage from the second gas inlet to fourth gas inlet is reduced.

13. A natural gas liquefaction method comprising:

removing heat from a refrigerant flow of a first refrigerant compressed by the compressor system of claim 1;

dividing the refrigerant flow into a first partial stream, a second partial stream, a third partial stream and a fourth partial stream;

expanding each partial stream at a respective pressure level;

removing heat from at least one of a second refrigerant and natural gas flowing in a natural gas line by means of the partial streams;

introducing the first partial stream and the second partial stream into the first gas inlet and the second gas inlet of the first compressor unit of the compressor system respectively;

introducing the third partial stream and the fourth partial stream into the third gas inlet and the fourth gas inlet of a second compressor unit of the compressor system respectively; and introducing the first refrigerant compressed by the first compressor unit into the fourth gas inlet of the second compressor unit.

14. The compressor system of claim 1, wherein a single gas flow of the first refrigerant at the first gas pressure level and a single gas flow of the first refrigerant at the second gas pressure level are provided to the first compressor unit.

* * * * *